US006095657A

United States Patent [19]

Kent

[11] Patent Number: 6,095,657

[45] Date of Patent: Aug. 1, 2000

[54] HANDS-FREE FLASHLIGHT ASSEMBLY AND HARNESS THEREFOR

[76] Inventor: Christopher Bruce Kent, 425 Cuckoo's Nest Road, R.R.6., Smiths Falls, Ontario, Canada, K7A 4S7

[21] Appl. No.: 09/285,780

[22] Filed: Apr. 5, 1999

[51] Int. Cl.[7] ..... F21L 4/02; F21L 4/04

[52] U.S. Cl. ..... 362/108; 362/184; 362/191; 362/199

[58] Field of Search ..... 362/103, 108, 362/184, 190, 191, 197–199, 239, 250

[56] References Cited

U.S. PATENT DOCUMENTS

| | | | |
|---|---|---|---|
| 2,495,265 | 1/1950 | Krogman | 362/108 |
| 2,555,871 | 6/1951 | Caggiano | 362/108 |
| 4,328,533 | 5/1982 | Paredes | 362/108 |
| 4,849,863 | 7/1989 | Gallegos | 362/108 |
| 4,967,323 | 10/1990 | Johnson et al. | 362/103 |
| 5,070,436 | 12/1991 | Alexander et al. | 362/108 |
| 5,183,324 | 2/1993 | Thomas | 362/103 |
| 5,193,896 | 3/1993 | Oberlander | 362/103 |
| 5,599,089 | 2/1997 | Sheu et al. | 362/198 |
| 5,690,413 | 11/1997 | Coughlin | 362/108 |

*Primary Examiner*—Alan Cariaso
*Attorney, Agent, or Firm*—Jones, Tullar & Cooper, PC

[57] ABSTRACT

A flashlight assembly has a body with spaced end portions each attachable to one of two shoulder straps so that the body may be suspended across the chest of a user with its end portions level. The body includes a battery compartment and a switch, and each end portion has lugs pivotally mounting a lamp, each lamp including a reflector and a light source connectable to a battery in the compartment via the switch. The lamps are independently pivotal through at least a right angle about a horizontal axis such that with the body held in position across the user's chest, the lamps may be adjusted so that one provides a light beam capable of illuminating the ground near the user's feet while the other illuminates objects in front of the user, or alternatively so that both lamps may illuminate objects in front of the user.

11 Claims, 1 Drawing Sheet

HANDS-FREE FLASHLIGHT ASSEMBLY AND HARNESS THEREFOR

BACKGROUND OF THE INVENTION

1. Field of the Invention

The present invention relates to a flashlight assembly particularly for use by sportsmen, fishermen, campers, electricians, and others who need to use a flashlight in a hands-free manner while both hands are occupied with various tasks.

2. Prior Art

Various flashlights are known which are usable in a hands-free manner. Some of these can clip onto a user's belts or onto other items of clothing. Also known are safety vests or similar articles, such as belts, for road workers or joggers, which incorporate lights; however these are lights with little illuminating power, being only intended to ensure that the wearer is visible at night. Examples of such devices are shown in the following U.S. patents:

U.S. Pat. No. 4,849,863, issued Jul. 18, 1989 to Gallegos;

U.S. Pat. No. 4,967,323, issued Oct. 30, 1990 to Johnson et al.;

U.S. Pat. No. 5,070,436, issued Dec. 3, 1991 to Alexander et al.;

U.S. Pat. No. 5,183,324, issued Feb. 2, 1993 to Thomas;

U.S. Pat. No. 5,193,896, issued Mar. 16, 1993 to Oberlander,

U.S. Pat. No. 5,690,413, issued Nov. 25, 1997 to Coughlin.

The Gallegos and Thomas patents show examples of devices which are fastened to, or incorporated in, a user's belt; these may be suitable for certain purposes but do not always provide the best location for a light being used by a person, for example, putting bait on a fishing hook, or repairing an article or changing a tire, for which a higher light source may be preferable. The Oberlander patent shows a flashlight which may have a wrist strap, or may have a clip for attachment to a belt. The Johnson et al. patent shows a flashlight which has a clip and a pin allowing it to be attached to a shirt or blouse pocket; while this would allow positioning at chest level it would not seem to give a stable mounting.

The Alexander and Coughlin patents are concerned with safety vests which incorporate lamps. The lamps in these cases are fixed to the vests and do not have mounting means which allow them to be carried other than as parts of the vests. In the Alexander design, the lights are only intended to make the wearer visible, and are not such as would be useful for a person wishing to work by their light.

SUMMARY OF THE INVENTION

The present invention provides a hands-free flashlight assembly which incorporates two lamps which can be independently directed; for example one lamp can have its beam directed downwards and the other can provide a beam in front of the user, allowing the user to walk safely at night. Alternatively, when the user is concerned for example with seeing a fish hook, or an item which needs repair, for example on a car or boat, or wishes to read, he can direct beams of light from both lamps in generally the same forward direction. Having beams directed from two spaced lamps gives a wider area of illumination than can be obtained from a single lamp.

More specifically, in accordance with the present invention there is provided a flashlight assembly comprising:

a body having spaced end portions, each end portion having means for attachment to one of two shoulder straps, whereby the body may be suspended in position across the chest of a user with its end portions generally level, the body including a battery compartment occupying space between the end portions;

each end portion having means pivotally mounting a lamp, each lamp including a reflector and a light source connectable by circuit means, including a switch, to a battery held in the battery compartment.

The lamps are independently pivotal through at least a right angle about a generally horizontal axis and such that with the body held in position across the user's chest, the lamps may be pivotally adjusted so that one provides a light beam capable of illuminating the ground near the user's feet while the other illuminates objects in front of the user, or alternatively so that both lamps may be directed to illuminate objects in front of the user.

The attachment means may include strap receiving slots adjacent to upper and lower extremities of the end portions, the lamps being positioned between these extremities. These attachment means allow easy adjustment of the vertical position of the lamps, so that they can be put in the best position for the user's specific need.

The battery compartment may serve as a connecting member between the two end portions. The mounting means for each lamp may include an inner lug which is formed partly integrally with an associated end of the battery compartment. Preferably, the lamps are separated by a distance of at least three inches.

The invention also includes a combination of a flashlight as set out above, and a harness suitable for holding the flashlight in position, the position of the flashlight being adjustable and including a position at the chest level.

BRIEF DESCRIPTION OF THE DRAWINGS

A preferred embodiment of the invention will now be described by way of example with reference to the accompanying drawings, in which.

DETAILED DESCRIPTION.

Figure 1:
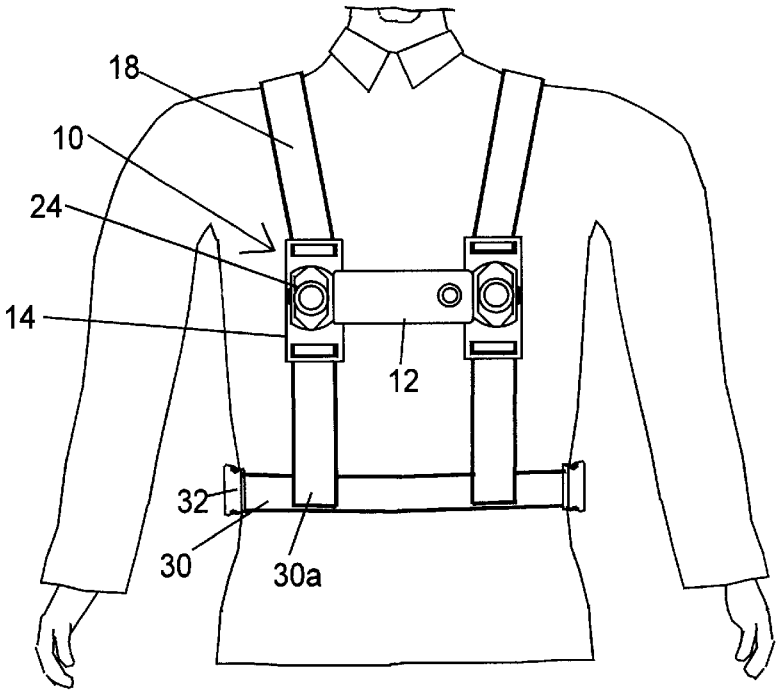
FIG. 1 is a front view of the flashlight assembly and harness of this invention positioned on the torso of a user.
Figure 2:
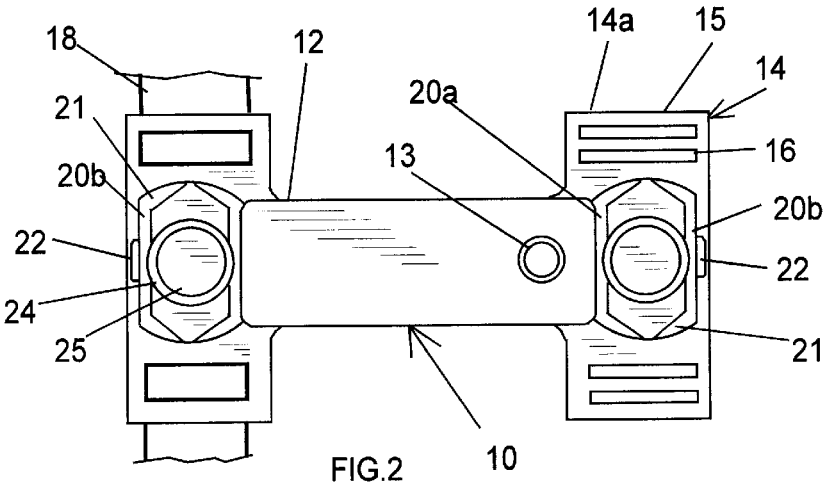
FIG. 2 is an enlarged front view of the flashlight assembly, with one shoulder strap removed.
Figure 4:
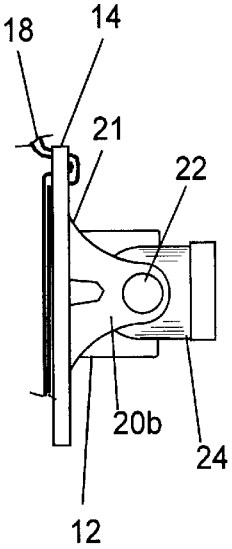
FIG. 4 is a side view of the flashlight.
Figure 3:
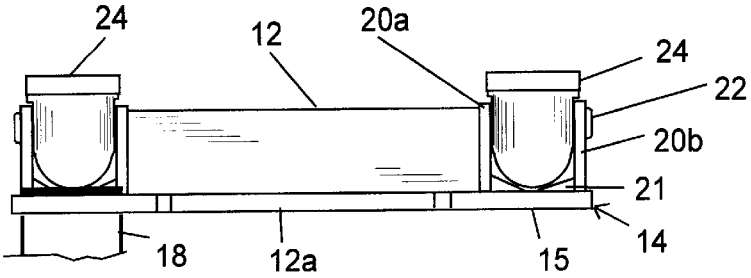
FIG. 3 is a top view of the flashlight.

Referring to the drawings, the flashlight has a body 10 with central, rectangular body portion 12 and two end portions 14. The body portion 12 is hollow and includes a compartment for batteries, not shown, and which is accessible from the rear of the body. The body portion also has a small compartment containing an on/off switch with an actuator shown at 13. End portions 14 are formed by generally planar extensions 15 of the rear wall 12*a* of the body portion 12. These end portions each have upper and lower extremities 14*a*, each of which have a pair of parallel slots 16, shown in FIG. 2, through which are threaded the shoulder straps 18 of the harness to be described.

The planar walls 15 of the two end portions each carry a pair of inner and outer lugs 20*a* and 20*b*, these being forwardly projecting and vertically oriented, and being joined to the walls 15 by gussets 21. The inner lugs 20*a* are adjacent and integrally formed with the associated ends of the body portion 12. The pairs of lugs 20*a* and 20*b* at each end of the flashlight have bearings which receive pivot pins 22 supporting the sides of a lamp 24; only the outer pins 22 are shown since the inner pins are inserted from inside the lamps when the front lenses 25 are not in place. The pivot mountings provided by these pins and lugs allows the lamps to pivot on a horizontal axis through at least a right angle, and preferably through about 1600. A ratchet between the lugs and lamps hold them in place once set.

Lamps 24 may be of conventional type used in flashlights, and may be the same as the pivoting heads of flashlights already commercially available. These lamps each have a light source such as a conventional bulb protected by the front lens 25, each bulb being connected by wires and circuit means, including the switch 13, to batteries contained in the body 12. The circuit components, including the switch, can be conventional, and may include slip rings at the sides of the lamps and contacts on the inner surfaces of the lugs. The flashlight is thus self-contained, and does not require a separate battery pack as is the case with many prior art devices.

The harness for holding the flashlight in hands-free manner includes the shoulder straps 18, and front and rear belt portions of which only the front portion 30 is shown. This belt portion is sewn at 30*a* to the lower ends of the shoulder straps 18, and terminates at the sides in push-in buckles 32 which connect on to a similar belt portion at the back of the wearer, and which anchor the rear portions of the shoulder straps. Thus, the harness includes an arrangement of front and rear shoulder straps and belt portions which is generally symmetrical front and rear, and the flashlight body serves as a connecting member between the front portions of the shoulder straps. The separation of the lamps 24, and of the shoulder straps 18, is at least 3 inches, and the centers of the lamps are preferably about 4.5 to 5 inches apart. To provide stability, the separation between the slots 16 closest to the lamps 24, at each end portion, is at least about 2 inches.

In use, the positions and orientation of the lamps will be set in accordance with circumstances. As shown, the flashlight is set just below the vertical center between the belt and the shoulder, but of course this height may be altered as required by moving the straps in the apertures 16. For walking, one lamp may be used to direct a beam ahead, while the other is oriented downwards to light the path being taken. In working on fish hooks, reading, or manual tasks, both lamps may be directed forwards, or lightly upwards, in which case the two lighted beams from the lamps can illuminate both sides of a close object.

I claim:

1. A flashlight assembly comprising:

a body having spaced end portions, each end portion having means for attachment to one of two shoulder straps, whereby the body may be suspended in position across the chest of a user with its end portions generally level, the body including a battery compartment occupying space between said end portions;

each end portion having means pivotally mounting a lamp, each lamp including a reflector and a light source connectable by circuit means to a battery held in said compartment, said lamps being independently pivotal through at least a right angle about a generally horizontal axis and such that with the body held in position across the user's chest, the lamps may be pivotally adjusted so that one provides a light beam capable of illuminating the ground near the user's feet while the other illuminates objects in front of the user, or alternatively so that both lamps may illuminate objects in front of the user.

2. A flashlight according to claim 1, wherein said attachment means includes strap receiving slots adjacent to upper and lower extremities of said end portions, the lamps being positioned between said extremities.

3. A flashlight according to claim 1, wherein said battery compartment and an associated switch compartment together serve as a connecting member between the two end portions.

4. A flashlight according to claim 3, wherein said mounting means for each lamp include an inner lug which is formed partly integrally with an associated end of the battery compartment.

5. A flashlight according to claim 1, wherein said lamps are separated by a distance of at least three inches.

6. A flashlight and harness combination, comprising:

a harness including two shoulder straps for positioning over the shoulders of a user, and a belt connecting said straps at the front and back of the user;

a flashlight body having spaced end portions, each end portion having means for attachment to one of said two shoulder straps, whereby the body may be suspended in position across the chest of a user with its end portions generally level, the body including a battery compartment occupying space between said end portions;

each end portion having means pivotally mounting a lamp, each lamp including a reflector and a light source connectable by circuit means to a battery held in said compartment, said lamps being independently pivotal through at least a right angle about a generally horizontal axis and such that with the body held in position across the user's chest, the lamps may be pivotally adjusted so that one provides a light beam capable of illuminating the ground near the user's feet while the other illuminates objects in front of the user, or alternatively so that both lamps may illuminate objects in front of the user.

7. A flashlight and harness assembly according to claim 6, wherein said straps are received in slots adjacent to upper and lower extremities of said end portions, the lamps being positioned between said extremities, the straps being adjustable in the slots to adjust the height of flashlight.

8. A flashlight and harness assembly according to claim 6, wherein said battery compartment and an associated switch compartment together serve as a connecting member between the two end portions.

9. A flashlight and harness assembly according to claim 6, wherein said mounting means for the lamps each include an inner lug which is formed partly integrally with an associated end of the battery compartment.

10. A flashlight and harness assembly according to claim 6, wherein said lamps are separated by a distance of at least three inches.

11. A flashlight and harness assembly according to claim 7, wherein those of said slots which are closest to the lamps are separated by at least 2 inches.

* * * * *